US007021880B2

(12) United States Patent
Morelli et al.

(10) Patent No.: US 7,021,880 B2
(45) Date of Patent: Apr. 4, 2006

(54) PIPE HANDLING APPARATUS FOR PRESENTING SECTIONS OF PIPE TO A DERRICK WORK FLOOR HAVING A HIGH-SPEED CARRIAGE ASSEMBLY

(75) Inventors: Vince E. Morelli, Red Deer (CA); Richard Arnold Handley, Red Deer (CA); Darren Shiels, Red Deer (CA); Sean Freeman, Red Deer (CA)

(73) Assignee: Pipe Wranglers Canada (2004) Inc., Red Deer (CA)

( * ) Notice: Subject to any disclaimer, the term of this patent is extended or adjusted under 35 U.S.C. 154(b) by 218 days.

(21) Appl. No.: 10/418,267

(22) Filed: Apr. 18, 2003

(65) Prior Publication Data

US 2004/0208730 A1 Oct. 21, 2004

(51) Int. Cl.
*E21B 19/00* (2006.01)

(52) U.S. Cl. ..... 414/22.59; 414/279

(58) Field of Classification Search ..... 414/22.54, 414/22.57, 22.58, 276, 279, 280, 800, 22.5, 414/22.59

See application file for complete search history.

(56) References Cited

U.S. PATENT DOCUMENTS 2,628,725 A * 2/1953 Stone ..... 414/22.63
2,643,006 A * 6/1953 King ..... 414/22.52
3,616,941 A * 11/1971 Walling ..... 414/746.2
3,750,804 A * 8/1973 Lemelson ..... 414/276
3,792,783 A * 2/1974 Brown ..... 414/22.62
4,386,883 A * 6/1983 Hogan et al. ..... 414/22.61
4,403,898 A * 9/1983 Thompson ..... 414/22.58
4,439,091 A * 3/1984 Frias ..... 414/22.59
4,494,899 A * 1/1985 Hoang et al. ..... 414/22.61
6,079,925 A * 6/2000 Morgan et al. ..... 414/22.57

* cited by examiner

*Primary Examiner*—Richard Ridley
(74) *Attorney, Agent, or Firm*—J. Jay Haugen; William J. Bundren

(57) ABSTRACT

A pipe handling apparatus for raising and lowering pipe to and from a raised derrick work floor. The apparatus comprises a longitudinally-extending base, with a longitudinally-extending cavity therein. An elongate, longitudinally-extending boom member is provided, which is adapted for raising out of and nestable positioning in such cavity. The boom member has a longitudinally-extending trough therein on an upperside surface thereof, adapted to receive at least one section of pipe. At least one arm member is coupled to the boom member for raising a proximal end of such boom member. A carriage member, slidably coupled to the boom member, is moveable longitudinally along the boom in the trough. The carriage member is adapted to engage and slidably transport one end of the pipe along the trough. Motive means are provided to permit powered movement of the carriage member along the boom.

18 Claims, 7 Drawing Sheets

PIPE HANDLING APPARATUS FOR PRESENTING SECTIONS OF PIPE TO A DERRICK WORK FLOOR HAVING A HIGH-SPEED CARRIAGE ASSEMBLY

FIELD OF THE INVENTION

The invention relates generally to pipe handling systems, and in particular to an apparatus for providing drill pipe to, and receiving drill pipe from, the work floor of a derrick or rig.

BACKGROUND OF THE INVENTION

Drill strings of pipe for oil and gas wells are assembled or disassembled vertically on a derrick one joint at a time, and are stored horizontally on pipe racks situated on the ground adjacent the rig. The work floor of the rig is typically elevated substantially above the pipe rack such that transferring sections of pipe to and from the racks and the work floor is necessary, and further requires careful handling of the heavy pipe to protect the workers and the pipe.

Conventional systems based on a boom having a pipe receiving trough in which pipe may be placed typically also include some way to assist with moving heavy sections of pipe along and out of such trough.

A variety of pipe cars, skates, bumpers, conveyors, stops and other devices (e.g. U.S. Pat. No. 4,371,302) have been described to control the motion of sections of pipe between a rig and ground.

For example, the applicant's Canadian application CA 2224638 relies on a spring loaded bumper mounted on the proximal end of a telescoping rod to push sections of pipe along the trough as well as to absorb the impact of pipe sliding down the trough toward the distal end thereof.

U.S. Pat. No. 6,533,519 to Tolmon ('519') issued 18 Mar. 2003 teaches a carriage member separate from a pusher member, both driven on a single axis aligned with the center of a pipe receiving groove. Disadvantageously, '519 and similar "ram based" designs that push a carriage member up the center of a trough require heavy, bulky hydraulic cylinders that are often restricted along the trough they can move a carriage, and further have limited response times such that the average speed of the carriage is low, causing pipe handling operations to take significant time.

U.S. Pat. No. 3,143,221 to Blacken ('221') issued 4 Aug. 1964 teaches a pipe car pulled and released by a cable, having 2 sets of side-mounted wheels each set having a common axle, the wheels running in a channel in a fixed track. Importantly, the track along which the pipe car is designed to roll is stationary and does not move vertically or longitudinally like the boom of most modern pipe handling systems. Disadvantageously, this wheeled pipe car design and other similar pipe car designs that are pulled by a single cable along a center line, although capable of running substantially the full length of the boom, are unstable and the wheels and axles tend to wear prematurely with the wheels binding in their guide tracks. A further disadvantage of the discrete wheel & track based design is that the coupling of the pipe car to the pipe handling system takes place at only four discrete points on the tracks, at any given moment. Very significantly the stability of the 221 design is problematic when the track in which the wheeled pipe car rides must move between the ground and work floor levels such that a reinforced track and a braking assembly become necessary. No pipe car design incorporating such features and which provides a relatively inexpensive addition to a raiseable pipe-handling apparatus is known.

The prior art in the oil field services industry has concentrated on teaching variations on center-line pushing devices covering only a portion of the boom length. Designs based on pipe cars having discrete wheels situated in tracks provide a limited coupling of the pipe carrying device ("car") to a relatively fragile set of members, resulting in a design that is less reliable, less stable and less safe than might be achieved using similar components. Moreover, none of the prior art reviewed teaches a device that is driven in both directions on both sides, failing to address the risk of runaway pipe cars.

Accordingly, there exists a real need for a pipe handling apparatus which provides such features as braking and ability to propel a pipe car in two mutually opposite directions, so as to improve modern pipe handling apparatus.

SUMMARY OF THE INVENTION

In one broad aspect of the invention there is provided a pipe handling apparatus for presenting sections of pipe to a raised derrick work floor, comprising: a longitudinally extending base having a proximal end and a distal end, operable in a generally horizontal position, having a longitudinal cavity between the proximal and distal ends; a longitudinally extending boom adapted for nestable positioning in the cavity, further having a longitudinally extending trough extending laterally within the boom for receiving at least one section of pipe therein; an arm coupled to the boom for raising a proximal end of the boom out of the cavity to a position proximate the floor for the purpose of presenting at least one section of pipe to the floor; and a carriage slidably coupled to the boom and moveable longitudinally along the boom for moving pipe longitudinally along the trough. The longitudinally extending base typically comprises a framework, having a catwalk around the longitudinal cavity to permit access to the trough, together with a suitable power supply and controls.

In a refinement of the above aspect, the trough further has first and second opposite sides, and the carriage comprises: a base member, having a distal end and a proximal end and laterally extending across the trough between first and second opposite sides and slidably coupled to the boom for longitudinal movement along the boom; and a pipe engaging device for engaging at least one pipe to assist movement of the pipe longitudinally along the trough. The carriage apparatus further comprises, in a preferred embodiment, a carriage drive assembly for longitudinally moving the carriage along the boom, including brakes for controlling and arresting the motion of the carriage along the boom.

In a further refinement, the carriage drive assembly comprises a motor adapted for turning gears, or sprockets and chains, or pullies and belts, or spindles and cables each to facilitate movement of the carriage along the boom, such may further include an idler or other assembly for tensioning the chains, or belts, or cables.

In a further refinement of the invention, the boom has a first side and a second opposite side; and the base member has a first edge and a second edge each outwardly extending to surround respectively a portion of each of the first and second sides of the boom so as to permit slidable securement of the base member to the boom. Further wherein the pipe engaging device comprises a rigid plate member secured to the base member in proximity to the distal end thereof for contacting pipe. Further wherein the rigid plate member includes means for reducing damage to the pipe, which may comprise elastomeric or other material applied to the rigid plate member to assist in preventing damage to pipe that is transported in the carriage.

In yet a further refinement of the invention, the carriage has means for releasably engaging the boom so as to prevent: undesired longitudinal movement of the carriage along the boom and/or undesired lateral movement of the carriage off the boom. The carriage further includes means for securing at least one section of pipe to the carriage during the movement of the base member along the boom.

In a further embodiment of the invention there is further provided an idler carriage member, longitudinally separated along the boom from said carriage, and slidably coupled to the boom and moveable longitudinally along the boom for assisting movement of pipe longitudinally along the trough when pipe is engaged with the drive carriage.

Each carriage member further, in a preferred embodiment, comprises means for reducing friction and facilitating movement of the base member along the boom, which in a preferred embodiment comprises a plurality of rollers situate between the base member and the trough. Examples of alternate means for reducing friction include: liquid lubricants such as oil, gases such as air or an inert gas under pressure, and opposing electro-magnetic fields.

In a further aspect, the carriage apparatus of the present invention, contemplates a wide-track, double-edge surround guide pair, with a low-profile base that is slideably coupled to a reinforced boom that also operates as a track, and a single or dual drive-line for bi-directional motion under power. Advantageously, by moving in the pipe trough the apparatus of the present invention achieves a full range of longitudinal motion while eliminating the cavity of older pipe car designs and reducing the pressure applied to the surface on which the apparatus glides. Further, a significant advantage results over the slower moving hydraulic pusher assemblies in that the average speed of the carriage of the present invention is higher permitting pipe handling operations to be accelerated.

According to a preferred dual drive-line implementation, the apparatus of the present invention is made more reliable and further stabilized since either drive-line may propel the carriage. Each drive-line adds to the mass of the entire assembly, creating an inertial or runaway dampening effect in the event that power is lost to either the drive motor or to the braking assembly. Advantageously, overhanging channel members are provided which prevent disengagement of the carriage with the trough thereby overcoming the problem of the limited coupling achieved in designs having only four discrete points on tracks, by substantially fully encompassing both sides of a reinforced boom along the entire length of the carriage being coupled thereto, resulting in more extensive coupling to the trough. Further, the positioning of the drive-lines on both sides of the carriage results in additional force securing the carriage to the boom at the same time as resisting the twisting action to which a single center-point attachment is more prone.

The accompanying drawings, which are incorporated in and constitute a part of this specification, illustrate preferred embodiments of the method, system, and apparatus according to the invention and, together with the description, serve to explain the principles of the invention.

BRIEF DESCRIPTION OF THE DRAWINGS

The present invention, in order to be easily understood and practised, is set out in the following non-limiting examples shown in the accompanying drawings, in which.

DETAILED DESCRIPTION OF THE PREFERRED EMBODIMENT

Reference is to be had to FIGS. 1–7 in which identical reference numbers identify similar components.

Figure 1:
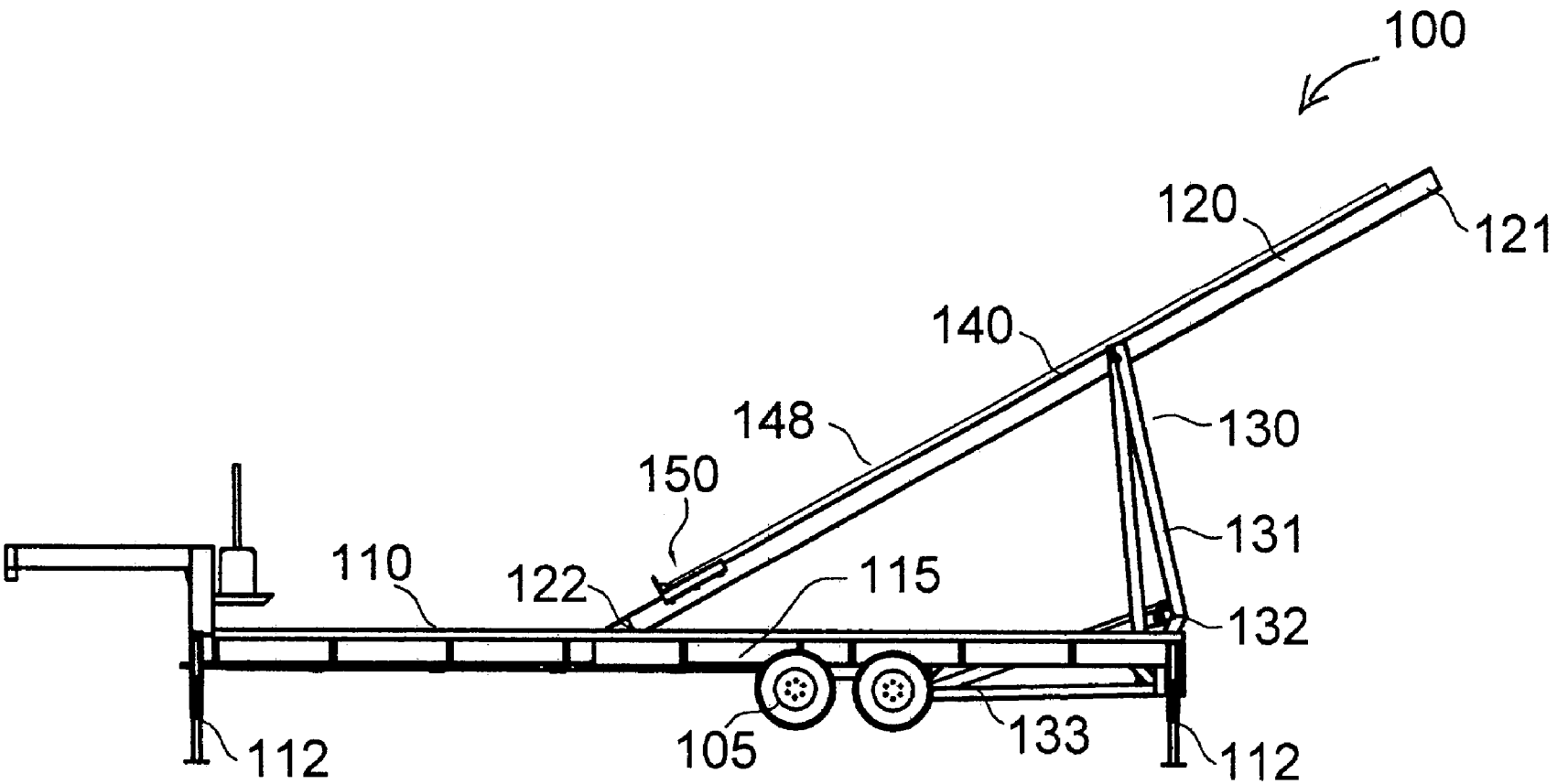
FIG. 1 is an illustration of one embodiment of the system of the present invention.

Referring to FIG. 1 there is illustrated a pipe handling system, denoted generally as 100 shown having base 110 mounted on undercarriage assembly 105 stabilized by legs 112 when in operation. Boom 120 is shown with proximal end 121 in a raised position moving toward a derrick work floor (not shown) with distal end 122 gliding along cavity 115 guided by track means (not shown), as actuating means 130 raises boom 120 out of cavity 115. Trough 140, having pipe 148 therein, extends longitudinally along boom 120 and may be formed therein or fastened thereon, but in either case trough 140 is adapted for receiving carriage assembly 150 adapted to be driven bi-directionally between the distal end 122 and the proximal end 121 of boom 120.

As shown in FIG. 1, carriage assembly 150 carries the distal end of pipe 148. The proximal end 121 of boom 120 is raised by any suitable actuating means 130, one embodiment of which comprises pivoting arm 131 and suitable linkage 132 actuated by hydraulic ram 133, for the purpose of presenting pipe 148 together with collars, or the like (not shown) laying in trough 140, to the rig floor for further handling, which process is commonly referred to as the "pick up" sequence. To return from the rig floor to ground, pipe 148 is lowered into proximal end 121 of boom 120 at the level of the rig floor and glides down trough 140 until it comes to rest against plate member 216 or pipe engaging member 220 (see FIG. 2) on carriage assembly 150 suitably positioned along boom 120. Actuating means 130 then lowers boom 120 with pipe 148 therein, such that in its fully lowered or "laid down" position boom 120 nests inside base 110. Although base 110 is illustrated in a mobile embodiment having any suitable undercarriage assembly 105, a person of skill in the art would understand that base 110 may also be of the stationary variety.

Figure 2:
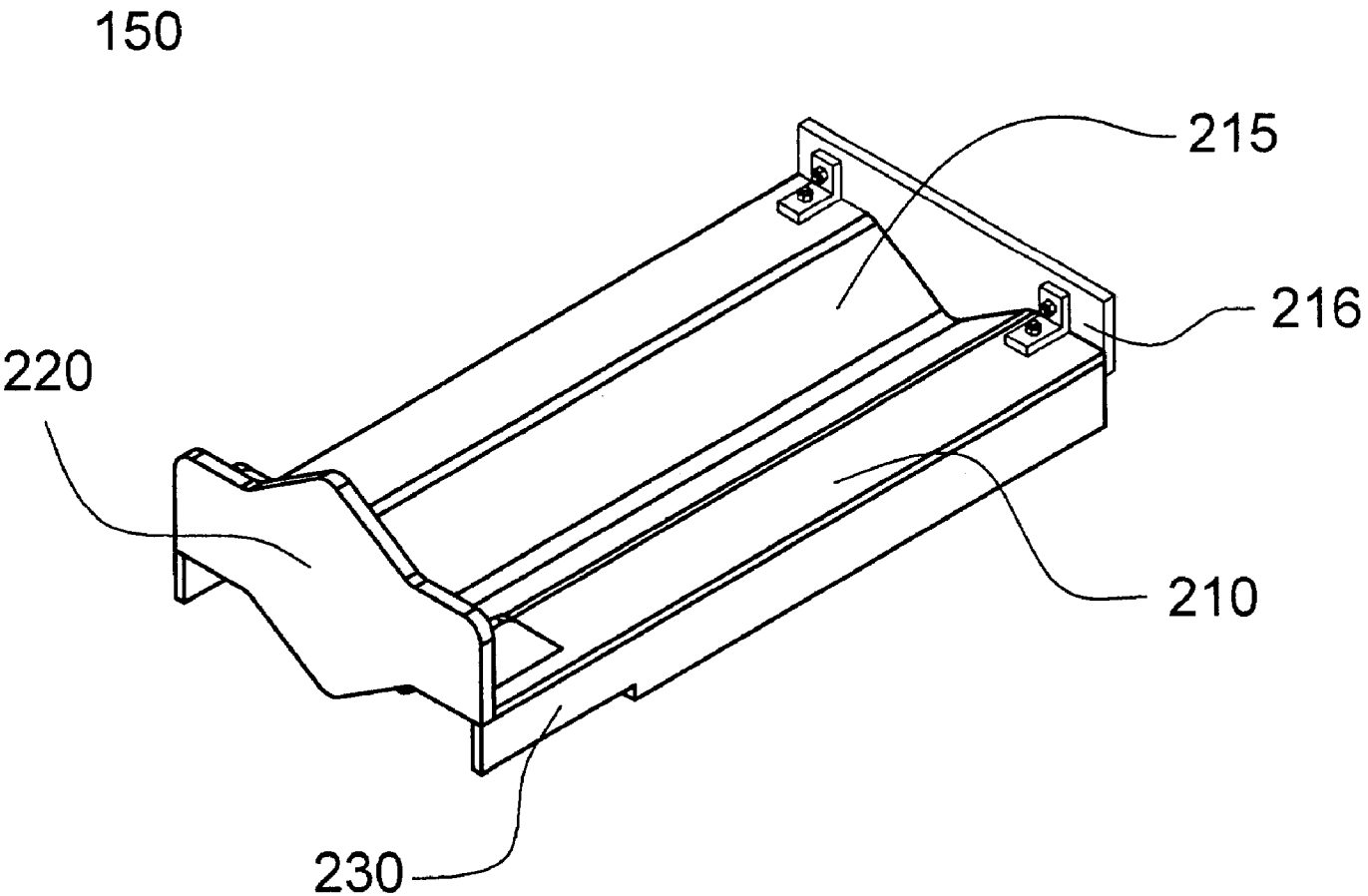
FIG. 2 is an illustration of some elements of the apparatus of the present invention.

Referring to FIG. 2 there is illustrated an embodiment of carriage assembly 150, showing base member 210 having formed therein a pipe receiving area 215 that conforms to trough 140 in boom 120. At one end of base member 210, one embodiment of pipe engaging member 220 is shown fastened to base member 210 in any suitable manner (e.g. bolted or welded) for the purpose of engaging one end of pipe 148 placed in receiving area 215.

Although pipe engaging member 220 has been illustrated as a simple "butt plate" at the distal end of base member 210, which plate is used for pushing or catching sections of pipe 148 respectively sitting or arriving into receiving area 215, it will be apparent to a person of skill in the art that by modifying pipe engaging member 220 to have a suitable passage there through combined with means for securing pipe 148 to receiving area 215 (e.g. electromagnets that could engage or release by remote control) would permit pipe engaging member 220 to be situated at different longitudinal positions along base member 210. Also illustrated formed in or coupled to base member 210 is one embodiment of catch 230 (shown in FIG. 2 as a double-edge surround guide pair) for slidable coupling to and releasable engagement of base member 210 with boom 120.

According to a preferred embodiment, base member 210 of carriage assembly 150 includes an auto-centering trough design and an elastomeric lining 218 that each advantageously significantly enhance the safety of pipe handling. Trough 140 has a substantially v-shaped cross-section that tolerates a "pitch and roll" of approximately 30 degrees (whereas 10 degrees is the industry standard at which off-shore drilling rigs shut down operations because of the risk that conventional trough designs will release pipe) at the same time as facilitating pipe 148 "finding center" and resting stably in trough 140 rather than rocking back and forth before coming to rest as it would in a substantially circular cross-sectional trough. By further adding to pipe receiving area 215 of base member 210 a coating, layer, matting or other lining 218 of elastomeric material having a corrugated or similar surface to absorb kinetic energy and resist having pipe 148 rock or otherwise move once in trough 140 two advantages result. First, the safety of operation of system 100 is enhanced. Second, carriage assembly 150 may be used to pull pipe 148 away from the derrick as pipe 148 is lowered from the drill rig's "blocks" into trough 140. Advantageously, the ability to drag pipe with the full-travel range, high-speed carriage assembly 150 permits system 100 to remove pipe 148 from the derrick sufficiently quickly to allow the blocks to move free and true thereby avoiding having the blocks hit the derrick causing damage thereto necessitating the repair thereof.

Lining 218 may be applied to pipe receiving area 215 in a number of different ways (e.g. adhesive, spray-on, bolts, press fit) in a number of different orientations that depend on the particular form of lining 218 in use. According to a preferred embodiment lining 218 has a corrugated surface of ridges and is applied with those ridges oriented parallel to the direction of travel of carriage assembly 150 along boom 120.

According to an alternate embodiment of pipe engaging member 220 (shown in FIG. 6) spring-loaded, hinged, safety hood means may operate to semi-securely maintain an end of pipe 148 in receiving area 215 while the rest of pipe 148 is being lowered into trough 140. As the blocks are used to lower pipe 148 into carriage assembly 150 an end of pipe 148 contacts pipe engaging member 220 prior to the rest of the tube making contact with trough 140 during the interstitial period between which contacts being made pipe 148 may not be aligned with trough 140 such that it rocks longitudinally on boom 120 causing said end of pipe 148 to bounce upward in and possibly to exit receiving area 215. Advantageously as pipe 148 is lowered into receiving area 215 of carriage assembly 150 an end of pipe 148 contacts back plate 221 causing it to pivot about connection 222 triggering spring 223 to close hood member 224 over the distal end of pipe 148 thereby to semi-securely restrict the movement of said end of pipe 148 within receiving area 215. As the blocks lower pipe 148 fully into trough 140 the distal end of pipe 148 pushes carriage assembly 150 towards the distal end 122 of boom 120, and with pipe engaging member 220 having been triggered, if the weight of the blocks causes the distal end of pipe 148 to attempt to pop out of receiving area 215, then pipe 148 is less likely to escape such that system operational safety is enhanced.

Figure 3:
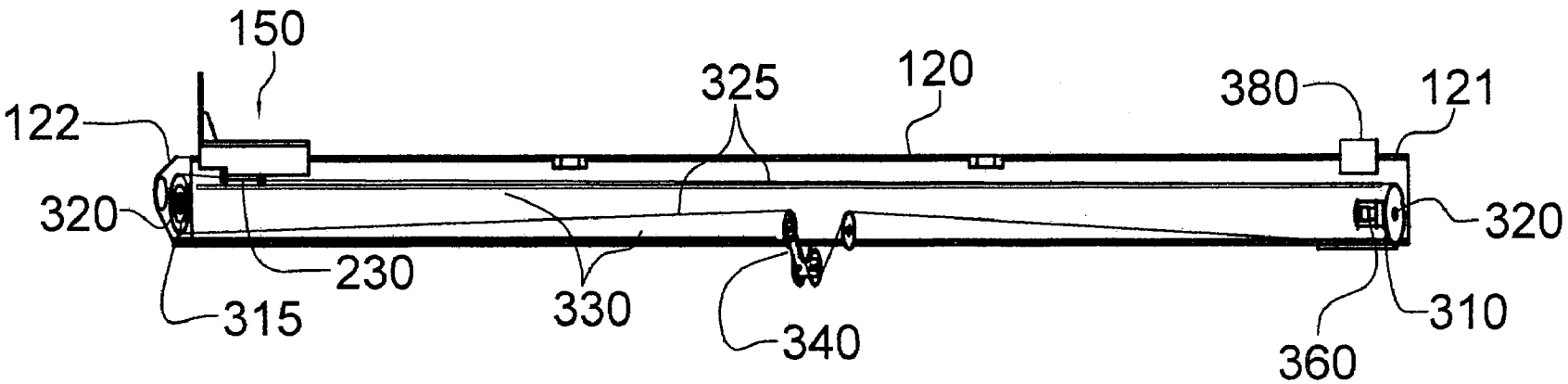
FIG. 3 is an illustration of one embodiment of the apparatus of the present invention shown together with elements of one embodiment of the drive assembly therefore.

Referring to FIG. 3 there is illustrated pipe handling system 100 including carriage drive assembly 300 comprising: motor 310, brakes 315, sprockets 320, chain 325, chain guides 330, and tensioning idler 340. Base member 210 connects to chain 325 at coupling points 350 proximate catch 230. As motor 310 drives chain 325 about sprockets 320, chain 325 causes carriage assembly 150 to move along boom 120 incrementally between proximal end 121 and distal end 122 either causing or allowing pipe 148 (not shown) to move along trough 140. According to one embodiment of the apparatus of the present invention motor 310 is fastened to boom 120 and then coupled to carriage assembly 150 by any suitable combination of elements. For example, but not in limitation, motor 310 may be coupled by any of: sprocket and chain, pulley and belt, or spindle and cable to base member 210 permitting the propulsion of carriage assembly 150 along boom 120. Similarly, any suitable control system (manual or automatic) may be used to cause motor 310 to engage or disengage, accelerate or decelerate carriage assembly 150 at suitable times and in a safe manner.

Motor 310 of carriage drive assembly 300 may be any rotating: hydraulic, electric, pneumatic, gasoline, diesel, propane, steam or other motive source capable of developing sufficient power to move the subject pipe. Further, motor 310 may be mounted to boom 120 at either the proximal end 121 or the distal end 122, however according to a preferred embodiment motor 310 is mounted inside boom 120 at proximal end 121 thereof in order to permit easy service of motor 310 when the distal end 122 of boom 120 is nested in cavity 115 and the proximal end 121 of boom 120 is only slightly raised out of cavity 115 for safe and easy access from base 110. Motor 310 may be reversible (permitting "engine braking") or it may "free-wheel" permitting carriage assembly 150 to return to the distal end of boom 120 under the weight of pipe in the trough, but it would in that embodiment typically be accompanied by a form of brake or clutch adapted to limit the acceleration of carriage assembly 150 as it returns to the distal end of boom 120.

According to another embodiment of the apparatus of the present invention, motor 310 may be fastened to the carriage base member 210, rather than to boom 120, in which case at least one motor 310 may be direct-drive coupled to boom 120 by an assembly of interacting gears (not shown) driving carriage assembly 150 along boom 120 against a toothed track fastened to boom 120 and substituted for guide 330. Either rotating or linear motors having suitable directional control and power supply switching means would be applicable to such embodiment.

In coupling base member 210 to motor 310 any suitable clutch, gear reduction, or other power transfer assembly (not shown) together with suitable activation control means may also be used to smooth out the motion and adjust the (weight carrying) capacity of carriage assembly 150. Similarly any suitable frictional or electromagnetic braking system applied at any suitable point (e.g. the motor hub or the chain, cable, or belt) whether in disc brake or drum brake format and having suitable means to control the activation and release thereof may be used to prevent runaway action by carriage assembly 150.

Suitable guides 330 and tensioning idler 340 may be operated with or without adjuster 360 (e.g. a hydraulic ram or worm gear shaft) to ensure that sufficient tension is applied to chain 325 (or suitable cable or belt) permitting the smooth, predictable motion of carriage assembly 150. Further, to facilitate operator ease of use stopping carriage assembly 150 at an appropriate (depending upon the presence of an idler carriage) location relative to proximal end 121 any suitable trip switch, electric-eye, or marker flag or combination thereof may be connected to boom 120 or trough 140 according to whether manual or automatic control is available with the subject embodiment of system 100.

By omitting pipe engaging member 220 from the embodiment of carriage assembly 150 illustrated in FIG. 2, an idler carriage 380 having substantially the same profile results. Typically the idler carriage 380 is not connected to the drive assembly (FIGS. 3–5) permitting it to free-wheel on boom 120 relative to carriage assembly 150. How the carriages are positioned relative to one another depends on whether or not pipe engaging member 220 permits pipe to pass through carriage assembly 150 or to terminate against pipe engaging member 220, but the idler carriage would typically be situated proximally relative to carriage assembly 150. According to an alternate embodiment idler carriage 380 may be connected a fixed distance from carriage assembly 150, permitting the reduction of friction (of a range of known pipe lengths transported in the resulting dual carriage assembly) by keeping both ends of any pipe or other material or equipment away from the surface of trough 140.

Figure 4:
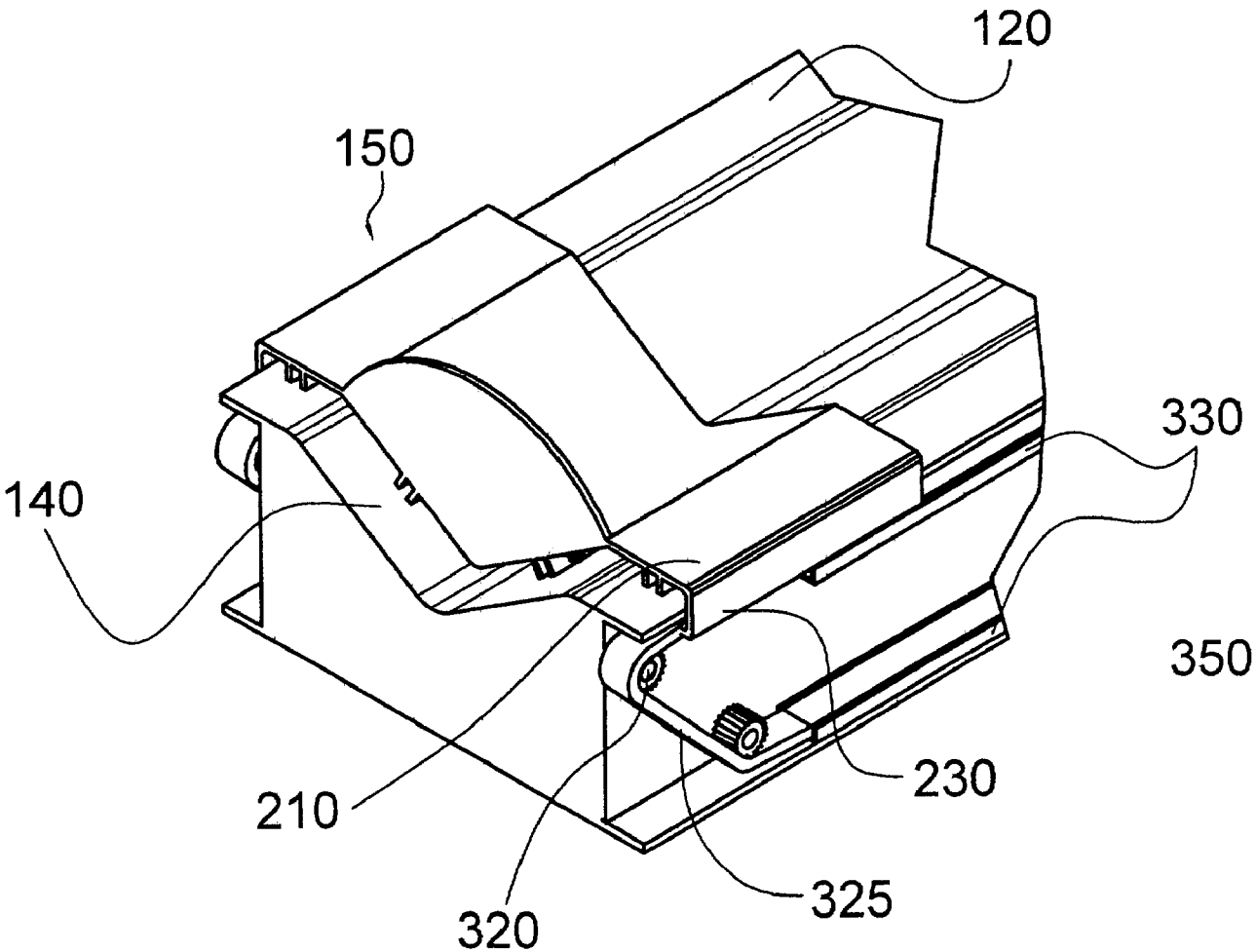
FIG. 4 is a close-up perspective view of one embodiment of the apparatus of the present invention together with some elements of a drive assembly therefore.

Referring to FIG. 4 there is illustrated an embodiment of elements of drive assembly 300 of carriage assembly 150 situate in trough 140 on boom 120, according to which a belt member 325 has been used in place of chain 325 of FIG. 3. A person of skill in the art of machine design would understand that any suitable belt 325 (e.g. toothed or smooth) together with a compatible set of transfer elements 320 (e.g. sprockets or pulleys) may be used according to the capacity of carriage assembly 150 required for the weight of pipe 148 being handled by the subject embodiment of system 100. As carriage assembly 150 moves along boom 120 belt 325 attached thereto at coupling points 350 is stabilized and directed by guides 330 keeping the moving belt 325 proximate boom 120 to avoid interference with base 110 or arm 131 as boom 120 moves vertically relative to cavity 115 and longitudinally relative to base 110. According to a preferred embodiment of the system of the present invention guides 330 are coated or lined with strips of plastic, vinyl or other non-metallic material having suitable wear-resistance advantageously causing chain 325 (or belt or cable) to operate more quietly and wear less quickly.

Figure 5:
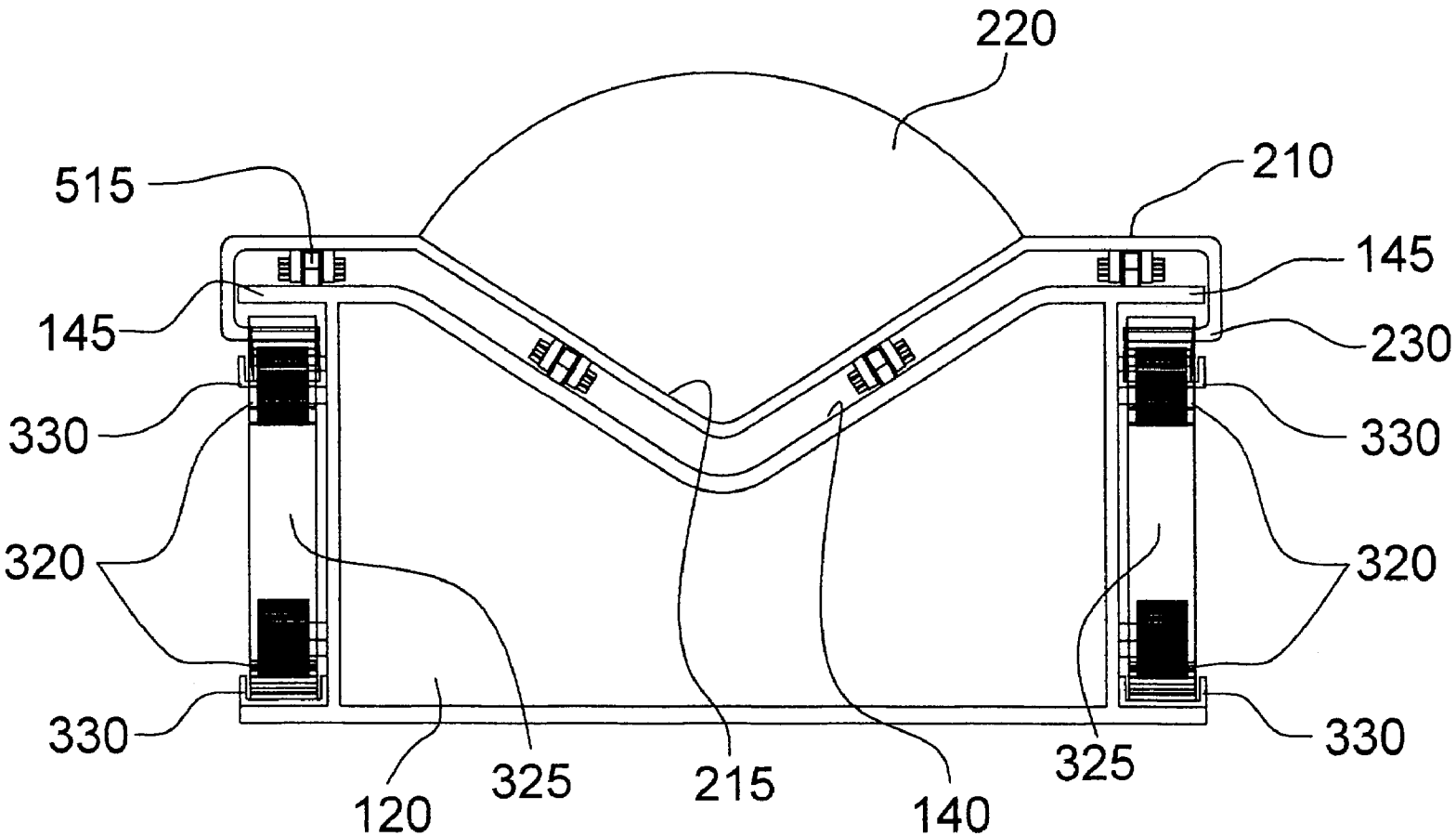
FIG. 5 is an end-view of one embodiment of the apparatus of the present invention seated on rollers in a trough together with some elements of a drive assembly therefore.
Figure 6:
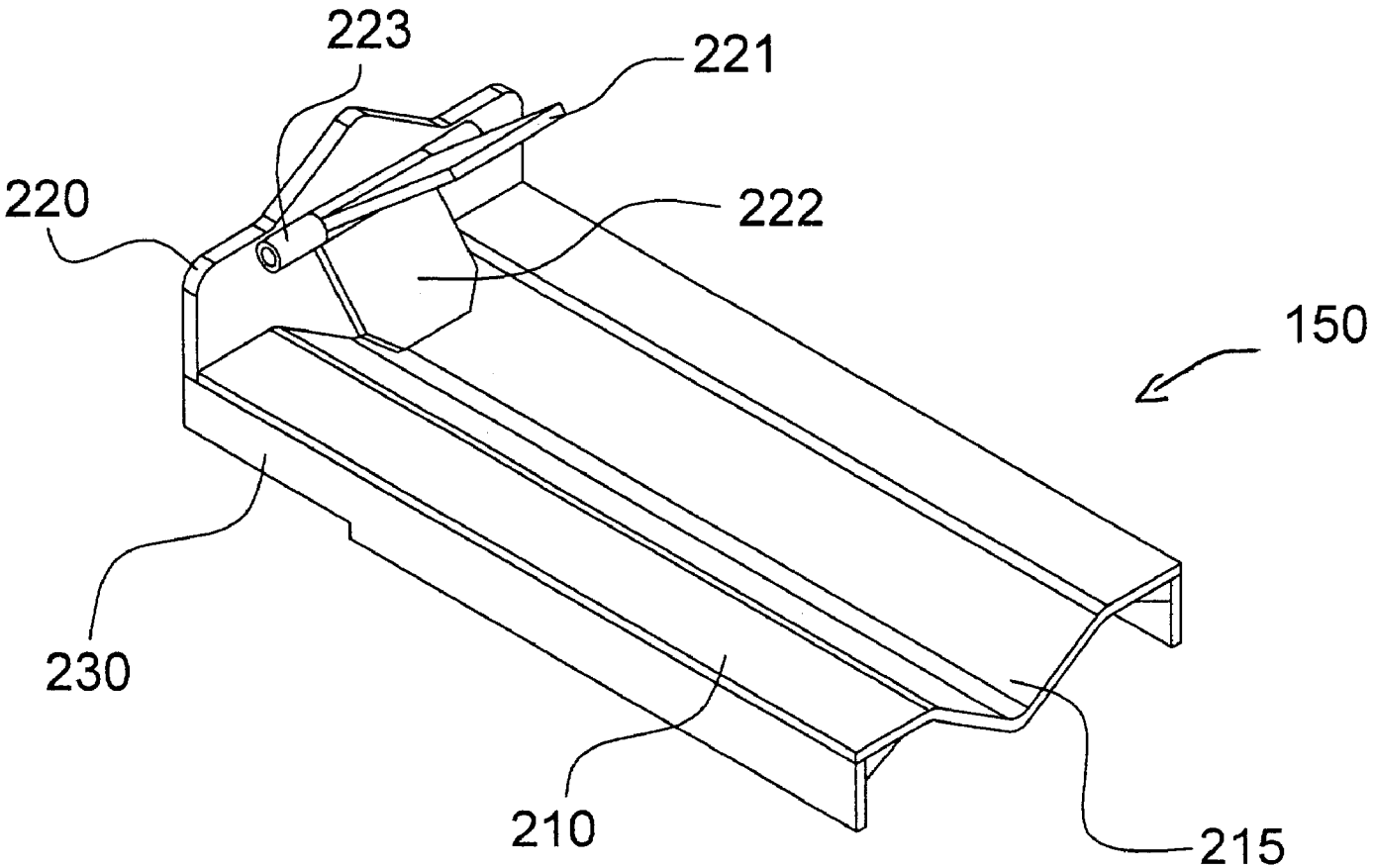
FIG. 6 is an illustration of an alternate embodiment to that of FIG. 2.
Figure 7:
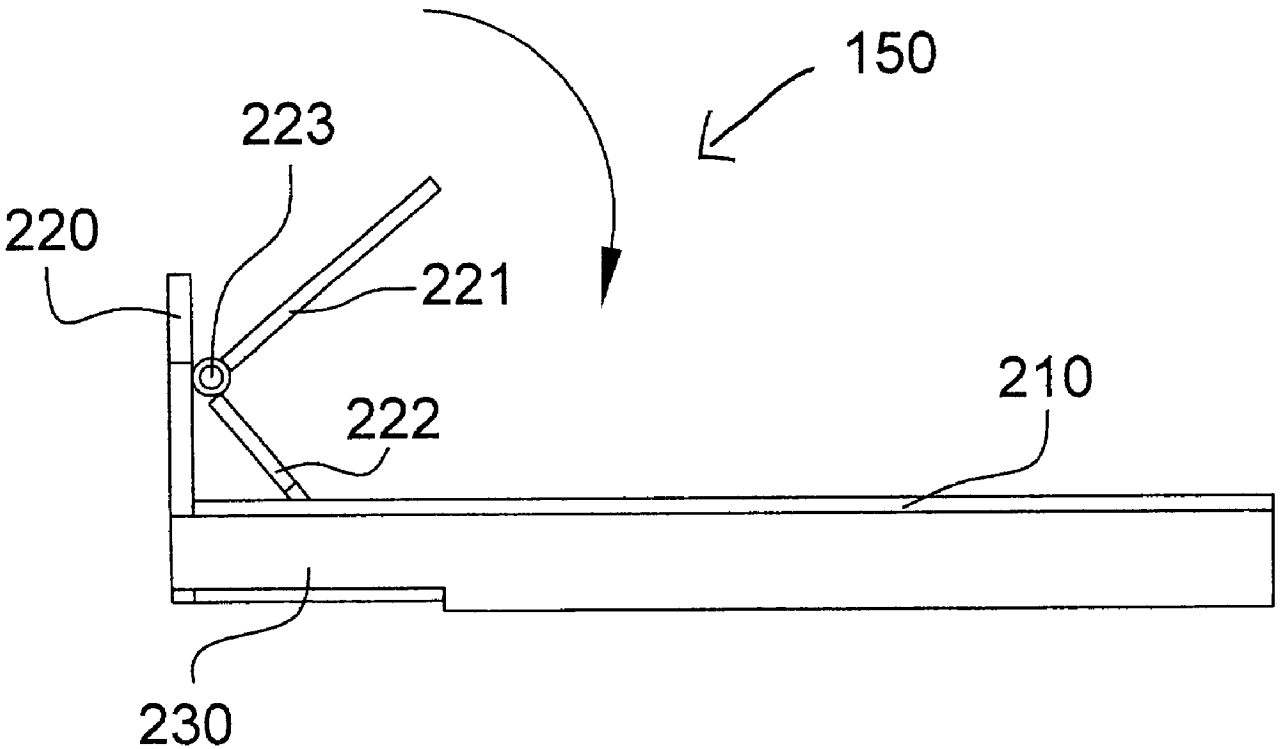
FIG. 7 is a side view of the alternate embodiment shown in FIG. 6.

Referring to FIG. 5 there is illustrated an end-view of one embodiment of select elements of drive assembly 300 for base member 210 situate in trough 140 on boom 120. Pipe engaging member 220 is shown as a solid "butt plate" embodiment used for pushing or stopping and terminating pipe 148 in receiving area 215. Base member 210 is isolated from trough 140 by any suitably positioned plurality of rollers 515 thereby advantageously reducing operating friction and wear. Base member 210 may also be isolated from trough 140 by any suitable cushion of fluid (e.g. air or oil) or field effect. Catch 230 is illustrated as a pair of channels attached to or formed in the sides of base member 210 in order to surround each edge 145 of trough 140 fastened to boom 120 for the purpose of both maintaining belt 325 adjacent boom 120 and preventing base member 210 being pulled too far away from trough 140 and unintentionally decoupling boom 120, advantageously stabilizing the operation of drive assembly 300 and enhancing safety. Coupling points 350 may be implemented below (as shown in FIG. 5), through, or above belt 325. According to a preferred embodiment of the system of the present invention each pair of edges 145 is carefully sized, aligned and mated to each pair of catches 230 to ensure that carriage assembly 150 advantageously runs free and true along boom 120 to avoid binding, jerky operation, and premature wear.

A dumping assembly (not shown) may be integrated into base 110 for receiving and ejecting, from base 110, pipe 148 ejected from trough 140 onto base 110. Further, an operator enclosure (not shown) that is weatherproof or chemical safe may be added to base 110 to permit workers to continue to handle pipe in hostile conditions. And, boom 120 may further comprise a telescoping "stinger" for extending the effective reach of boom 110 beyond proximal end 121.

Undercarriage assembly 105 having stabilizing legs 112 may comprise: a suitable wheel assembly 106, frame means integrated with or coupleable to base 110, at least one axle, suspension means, and towing or self-propulsion means, whereby wheel assembly 106 is coupled to the frame by the suspension connected to at least one axle, and the towing means is adapted for moving apparatus 100.

The terms and expressions employed in this specification are used as terms of description and not of limitation, and there is no intention in the use of such terms and expressions to exclude any equivalents of the features shown and described or portions thereof, and it is recognized that various modifications are possible within the scope of the invention claimed. Although the disclosure describes and illustrates various embodiments of the invention, it is to be understood that the invention is not limited to these particular embodiments. Many variations and modifications will now occur to those skilled in the art of machine design and drill pipe handling. For full definition of the scope of the invention, reference is to be made to the appended claims.

We claim:

1. A pipe handling apparatus for presenting sections of pipe to a raised derrick work floor comprising:

a longitudinally extending base having a proximal end and a distal end, operable in a generally horizontal position, having a longitudinal cavity between said proximal and distal ends;

guide track means extending along said longitudinal cavity;

longitudinally extending boom means having a proximal end and a distal end adapted for nestable positioning in said cavity, said distal end adapted to be guided along said cavity by said guide track means, said boom means further having a longitudinally extending trough for receiving at least one section of pipe therein, said trough having first and second opposite sides;

arm means coupled to said boom means for raising said proximal end of said boom means out of said cavity whereby said distal end of said boom means is adapted to glide along said guide track means towards said floor as said proximal end of said boom means is raised upwards and forwards to a position proximate said floor for the purpose of presenting said at least one section of pipe to said floor; and carriage means slidably coupled to said boom means moveable longitudinally along said boom means for moving said pipe longitudinally along said trough, said carriage means comprising a base member, having a distal end and a proximal end and laterally extending across said trough between first and second opposite sides and slidably coupled to said boom means for longitudinal movement along said boom means; and pipe engaging means for engaging said at least one section of pipe to assist movement of said pipe longitudinally along said trough, said pipe engaging means comprising a rigid plate member secured to said base member in proximity to the distal end thereof for contacting said pipe, said rigid plate member comprising damage reduction means for reducing damage to said at least one section of pipe.

2. The apparatus as claimed in claim 1 further comprising carriage drive means for longitudinally moving said carriage means along said boom means.

3. The apparatus as claimed in claim 2 said carriage drive means further comprising braking means for controlling and arresting the motion of said carriage means along said boom means.

4. The apparatus as claimed in claim 2 wherein said carriage drive means comprises motor means, said motor means adapted for turning gear means to propel said carriage means along said boom means.

5. The apparatus as claimed in claim 2 wherein said carriage drive means comprises motor means, said motor means coupled by sprocket means together with chain means, to said boom means for moving said carriage means along said boom means.

6. The apparatus as claimed in claim 2 wherein said carriage drive means comprises motor means, said motor means coupled by pulley and belt means to said boom means to facilitate movement of said carriage means along said boom means.

7. The apparatus as claimed in claim 2 wherein said carriage drive means comprises motor means, said motor means coupled by spindle and cable means to said boom means to facilitate movement of said carriage means along said boom means.

8. The apparatus as claimed in claim 1:

said boom means having a first side and a second opposite side; and said base member having a first edge and a second edge each outwardly extending to surround respectively a portion of each of said first and second sides of said boom means so as to permit slidable securement of said base member to said boom means.

9. The apparatus as claimed in claim 1, said carriage means having means for releasably engaging said boom means so as to prevent undesired longitudinal movement of said carriage means along said boom means.

10. The apparatus as claimed in claim 1 further comprising pipe securing means for securing said at least one section of pipe to said carriage means during the movement of said base member along said boom means.

11. The apparatus as claimed in claim 1 wherein said pipe engaging means comprises pipe securing means for securing said at least one section of pipe to said carriage means during the movement of said base member along said boom means.

12. The apparatus as claimed in claim 1 further comprising at least one friction-reducing means for facilitating said movement of said base member along said boom.

13. The apparatus as claimed in claim 12 wherein said friction-reducing means comprises, a plurality of rollers.

14. The apparatus as claimed in claim 1 further comprising idler carriage means longitudinally separated along said boom means, slidably coupled to said boom means and moveable longitudinally along said boom means for assisting movement of said pipe longitudinally along said trough when said pipe is engaged with said carriage means.

15. The apparatus as claimed in claim 5 further comprising tensioning means for tensioning said chain means.

16. The apparatus as claimed in claim 6 further comprising tensioning means for tensioning said pulley and belt means.

17. The apparatus as claimed in claim 7 further comprising tensioning means for tensioning said spindle and cable means.

18. The apparatus as claimed in claim 1 wherein said damage reduction means comprises resiliently flexible elastomeric material applied to said rigid plate member to assist in preventing damage to pipe that is transported in said carriage means.

* * * * *